United States Patent [19]

Kuhn et al.

[11] Patent Number: 4,877,646

[45] Date of Patent: Oct. 31, 1989

[54] METHOD FOR MAKING ELECTRICALLY CONDUCTIVE TEXTILE MATERIALS

[75] Inventors: Hans H. Kuhn, Spartanburg; William C. Kimbrell, Jr., Inman, both of S.C.

[73] Assignee: Milliken Research Corporation, Spartanburg, S.C.

[21] Appl. No.: 211,630

[22] Filed: Jun. 27, 1988

[51] Int. Cl.[4] ..... B05D 3/02; B05D 5/12

[52] U.S. Cl. ..... 427/121; 427/389.9; 428/265; 428/267; 428/395

[58] Field of Search ..... 427/121, 341, 342, 389.9; 428/265, 267, 395

[56] References Cited

U.S. PATENT DOCUMENTS

| | | | |
|---|---|---|---|
| 3,909,195 | 9/1975 | Machell et al. | 8/115.7 |
| 4,468,291 | 8/1984 | Naarmann et al. | 204/13 |
| 4,521,450 | 6/1985 | Bjorklund et al. | 427/121 |
| 4,547,270 | 10/1985 | Naarmann | 204/58.5 |
| 4,568,483 | 2/1986 | Naarmann et al. | 252/500 |
| 4,569,734 | 2/1986 | Naarmann et al. | 204/78 |
| 4,578,433 | 3/1986 | Muenstedt et al. | 525/417 |
| 4,604,427 | 8/1986 | Roberts et al. | 525/185 |
| 4,617,228 | 10/1986 | Newman et al. | 428/265 |
| 4,617,353 | 10/1986 | Myers | 525/245 |
| 4,642,331 | 2/1987 | Hodge | 528/492 |
| 4,696,835 | 9/1987 | Maus et al. | 427/121 |
| 4,697,000 | 9/1987 | Witucki et al. | 528/423 |
| 4,697,001 | 9/1987 | Walker et al. | 528/423 |
| 4,710,400 | 12/1987 | Gardini et al. | 427/121 |
| 4,710,401 | 12/1987 | Warren et al. | 427/121 |

FOREIGN PATENT DOCUMENTS 2133022 7/1984 United Kingdom .

2181367 4/1987 United Kingdom .

OTHER PUBLICATIONS

"Structure/Property Relationships in Electrochemically Grown Polypyrrole Films", Leonard J. Buckley, Gary E. Wnek and David K. Roylance, American Chemical Society Division of Polymeric Materials Science and Engineering, Polymeric Materials Science and Engineering, pp. 101-104, 1985.

"Some Properties of Polypyrrole-Paper Composites", Journal of Electronic Materials, vol. 13, No. 1, 1984.

"Electroactive Polymer Materials", State-Of-The-Art Review of Conductive Polymers, Anders Wirson, National Defense Research Institute, Stockholm, Sweden.

*Primary Examiner*—Michael Lusignan

*Attorney, Agent, or Firm*—Terry T. Moyer; H. William Petry

[57] ABSTRACT

Fabrics are made electrically conductive by contacting the fiber under agitation conditions with an aqueous solution of a pyrrole compound, an oxidizing agent and a doping agent or counter ion and then depositing onto the surface of individual fibers of the fabric a prepolymer of the pyrrole compound so as to uniformly and coherently cover the fibers with a conductive film of the polymerized pyrrole compound and wherein, furthermore, the oxidizing agent is a ferric salt and the aqueous solution further contains a weak complexing agent for ferric ions to effectively control the reaction rate such that the prepolymer is uniformly and coherently adsorbed onto the surface of the textile material, thereby providing improved films of electrically conductive polymerized compound on the textile material.

19 Claims, No Drawings

METHOD FOR MAKING ELECTRICALLY CONDUCTIVE TEXTILE MATERIALS

The present invention relates to a method for imparting electrical conductivity to textile materials and to textile materials made thereby. More particularly, the present invention relates to a method for producing conductive textile materials, such as fabrics, filaments, fibers and yarns h by depositing a forming polymer of pyrrole onto the surface of the textile material.

Electrically conductive fabrics have, in general, been known for some time. Such fabrics have been manufactured by mixing or blending a conductive powder with a polymer melt prior to extrusion of the fibers from which the fabric is made. Such powders may include, for instance, carbon black, silver particles or even silver- or gold-coated particles. When conductive fabrics are made in this fashion, however, the amount of powder or filler required may be relatively high in order to achieve the desired level of conductivity and this high level of filler may adversely affect the properties of the resultant fibers. It is theorized that the high level of filler is necessitated because the filler particles must actually touch one another in order to obtain the desired conductivity characteristics for the resultant fabrics.

Such products have, as mentioned briefly above, some significant disadvantages. For instance, the mixing of a relatively high concentration of particles into the polymer melt prior to extrusion of the fibers may result in undesired alteration of the physical properties of the fibers and the resultant textile materials.

Antistatic fabrics may also be made by incorporating conductive carbon fibers, or carbon-filled nylon or polyester fibers in woven or knit fabrics. Alternatively, conductive fabrics may be made by blending stainless steel fibers into spun yarns used to make such fabrics. While effective for some applications, these "black stripe" fabrics and stainless steel containing fabrics are expensive and of only limited use. Also known are metal-coated fabrics, such as nickel-coated, copper-coated and noble metal-coated fabrics, however, the process to make such fabrics is quite complicated and involves expensive catalysts, such as palladium or platinum, making such fabrics impractical for many applications.

It is known that polypyrrole may be a convenient material for achieving electrical conductivity for a variety of uses. An excellent summary in this regard is provided in an article by G. Bryan Street of IBM Research Laboratories, Volume 1, "Handbook of Conductive Polymers", pp. 266–291. As mentioned in that article, polypyrrole can be produced by either an electrochemical process where pyrrole is oxidized on an anode to a desired polymer film configuration or, alternatively, pyrrole may be oxidized chemically to polypyrrole by ferric chloride or other oxidizing agents. While conductive films may be obtained by means of these methods, the films themselves are insoluble in either organic or inorganic solvents and, therefore, they cannot be reformed or processed into desirable shapes after they have been prepared.

Accordingly, it has been suggested that the polypyrrole may be made more soluble in organic solvents by providing one or two aliphatic side chains on the pyrrole molecule. More recently it has been suggested that the pyrrole may be polymerized by a chemical oxidation within a film or fiber (see U.S. Pat. No. 4,604,427 to A. Roberts, et al.). A somewhat similar method has been suggested wherein ferric chloride is incorporated into, for instance, a polyvinyl alcohol film and the composite is then exposed to pyrrole vapors resulting in a conductive polymeric composite.

Another method for making polypyrrole products is described in U.S. Pat. No. 4,521,450 to Bjorklund, et. al. wherein it is suggested that the oxidizing catalyst be applied to a fiber composite and thereafter exposed to the pyrrole monomer in solution or vapor form. A closely related process for producing electrically conductive composites by precipitating conductive pyrrole polymer in the interstitial pores of a porous substance is disclosed in U.S. Patent 4,617,228 to Newman, et al.

On the other hand, the electrochemical deposition of polypyrrole on the surface of textiles could only be achieved if these fabrics would be, per se, electrically conductive. H. Naarmann, et al. describes such a process in DE 3,531,019A using electrically conductive carbon fibers or fabrics as the anode for the electrochemical formation of polypyrrole. It is obvious that such a process would be inoperative on most conventional textiles which are predominantly insulators or not sufficiently conductive to provide the necessary electrical potential to initiate polymerization.

Moreover, while the examples of the aforementioned patents to Roberts, et. al., Bjorklund, et. al. and Newman, et. al. show increased conductivity for various non-porous synthetic organic polymer films, impregnable cellulosic fabrics, and porous substances, respectively, these processes each have various drawbacks. For example, they require relatively high concentrations of the pyrrole compound applied to the host substrate. Another problem inherent to these processes is the requirement for separate applications of pyrrole monomer and oxidant, with one or the other first being taken up by the fabric, film, fiber, etc. and then the other reactant being applied to the previously impregnated host material. This dual step approach may involve additional handling, require drying between steps, involve additional time for first impregnation and then reaction. The process of Bjorklund, et al. as pointed out by Roberts, et al. has the additional deficiency of not being applicable to non-porous polymeric materials. On the other hand, the Roberts, et. al. process requires use of organic solvents in which the pyrrole or substituted pyrrole analog is soluble, thus requiring handling and recovery of the organic solvent with the corresponding environmental hazards associated with organic solvents. Still further, it is, in practice, difficult to control the amount of conductive polymer deposited in or on the substrate material and such convention processes may result in non-uniform coatings, loosely adherent polypyrrole ("pyrrole black") and inefficient use or waste of the pyrrole monomer.

These drawbacks and problems inherent in the non-electrochemical oxidative precipitation of conductive polymer on textile substrates were overcome to a large extent by the discovery by the inventors of the present application described in the prior, commonly assigned, application Ser. No. 81,069 filed Aug. 3, 1987 now U.S. Pat. No. 4,803,096, patented Feb. 7, 1989, (incorporated by reference), that textile substrates can be made more uniformly electrically conductive, with adherent polymer coverings, and with reduced waste of reactants, by contacting the textile substrate under agitation conditions, with an aqueous solution of a pyrrole or aniline compound and an oxidizing agent and a doping agent or counter ion; and then depositing onto the surface of the individual fibers of the textile substrate a forming polymer or prepolymer of the pyrrole or aniline monomer, thereby providing a uniform and coherent covering on the fibers of an ordered, conductive film of the polymerized pyrrole or aniline compound.

The process of the prior application differs significantly from the prior art methods for making conductive composites in that the substrate being treated was contacted with the polymerizable compound and oxidizing agent at relatively dilute concentrations and under conditions which did not result in either the monomer or the oxidizing agent being taken up, whether by adsorption, impregnation, absorption, or otherwise, by the textile substrate (e.g. preformed fabric or the fibers, filaments or yarns forming the fabric). Rather, the polymerizable monomer and oxidizing h reagent were first reacted with each other to form a "pre-polymer" species, which might be a water-soluble or dispersible free radical-ion of the compound, or a water-soluble or dispersible dimer or oligomer of the polymerizable compound, or some other unidentified "pre-polymer" species. In any case, it was the "pre-polymer" species, i.e. the forming polymer, which was deposited onto the surface of the individual fibers or filaments, as such, or as a component of yarn or preformed fabric or other textile material. This process required careful control of process conditions, such as reaction temperature, concentration of reactants (monomer, oxidizing agent and dopant) and textile material, and other process conditions (e.g. rate of agitation, other additives, etc.) so as to result in deposition of the pre-polymer species as they are being formed. In other words, the rate of polymerization and deposition onto the surface is such that the forming polymer is immediately deposited onto the surface of the fibers and is not deposited in the aqueous solution in the form of discrete particles. This resulted in a very uniform film being formed at the surface of individual fibers or filaments without any significant formation of polymer in solution and also resulted in optimum usage of the polymerizable compound so that even with a relatively low amount of prepolymer applied to the surface of the textile, a relatively high amount of conductivity was capable of being achieved.

The treated textile materials exhibited excellent hand characteristics which made them suitable and appropriate for a variety of end use applications where conductivity may be desired including, for example, antistatic garments, antistatic floor coverings, components in computers and, generally, as replacements for metallic conductors, or semiconductors, including such specific applications as, for example, batteries, photovoltaics, electrostatic dissipation and electromagnetic shielding, for example, as antistatic wrappings of electronic equipment or electromagnetic interference shields for computers and other sensitive instruments.

While the process previously described in Ser. No. 81,069 provides significant improvements over the prior art techniques, nevertheless, in practice it is often difficult to provide the precise process controls required to appropriately adjust the rates of polymer formation and adsorption, especially within appropriate boundaries for a commercial process. The use of low reaction temperatures, e.g. down to about 0° C. or below, for slowing the reaction rate is often inconvenient and adds additional expense to the overall process by virtue of increased energy costs and increased production time per unit of product.

It was pointed out in the prior application that one controlling factor in assuring that the forming prepolymer species forms at an appropriate rate to be taken up on the textile material without forming polymer in solution is the availability or concentration of the oxidant in the aqueous solution.

Example 19 on p. 31 of Ser. No. 81,069 demonstrates the influence of reactant concentration, including the $FeCl_3$ oxidant on the production of conductive polypyrrole films. As oxidant concentration increases the resistivity decreases.

On the other hand, it is disclosed in Example 27 on pp. 36–37 of the prior application that sodium diisopropylnaphthalene sulfonate and petroleum sulfonate, which are effective doping agents for electrically conductive polypyrrole films, "form a precipitate with $FeCl_3$ and, therefore, are not preferred in conjunction with iron salts. However, these two anionic surface active compounds do appear to accelerate the oxidative polymerization reaction".

On the basis of this information the present inventors attempted to control the availability and concentration of the iron salt oxidant, particularly $FeCl_3$, in the aqueous solution as a means of controlling the rate of oxidative polymerization of the pyrrole monomer. However, as will be shown by comparative examples to be given below, the addition of conventional complexing agents for ferric ($Fe^{+3}$) ion, such as ethylene diamine tetraacetic acid (EDTA) and potassium thiocyanate (KSCN) completely stop the polymerization of pyrrole, presumably by virtue of forming irreversible or strong complexes with $Fe^{+3}$, and preventing oxidation of the pyrrole monomer to the reactive species.

However, further research by the present inventors has led to the discovery that there is a class of compounds which are presumably capable of forming weak complexes with $Fe^{+3}$ and that when these complexing agents are included in the aqueous solution with the pyrrole monomer they effectively, controllably release the ferric ions and allow the polymerization to proceed at a rate such that the forming prepolymer species is deposited onto the surface of the fibers of the textile material as quickly as it is formed. As a result of this controlled release of ferric ions the conductive polymer film can be formed on the textile material at room temperature with uniform and coherent properties normally obtainable otherwise only at substantially lower temperatures (e.g. about 0° C.) in the absence of the complexing agent.

According to this invention, the addition to the aqueous solution of pyrrole monomer, and ferric oxidant, and optional dopant or counter ion, of certain complexing agents for the ferric oxidant provides a more effective means for controlling the rate of polymer formation such that over a broad range of operating conditions the forming pre-polymer is adsorbed onto the surface of the fibers in a more desirable and expeditious fashion while effectively avoiding undesired polymerization of the monomer in solution and thereby also avoiding precipitation of discrete particles which do not contribute to the electroconductivity of the treated textile substrate.

It is thus an object of the present invention to provide an improved method for preparing a highly conductive, ordered, coherent film on the surface of textile materials. Such resultant textile materials may, in general, include fibers, filaments, yarns and fabrics. The treated textile h materials exhibit the same excellent properties and characteristics as previously described and, therefore, are suitable and appropriate for the same end use applications as also previously described for conductive textile materials.

According to the present invention there is provided a method for imparting electrical conductivity to textile materials by (a) contacting the textile material with an aqueous solution of an oxidatively polymerizable pyrrole compound and an oxidizing agent capable of oxidizing said compound to a polymer, said contacting being carried out in the presence of a counter ion or doping agent which imparts electrical conductivity to said polymer when fully formed said contacting being under conditions at which the pyrrole compound and the oxidizing agent react with each other to form a prepolymer in said aqueous solution; (b) depositing onto the surface of the textile material the prepolymer of the polymerizable compound: and (c) allowing the prepolymer to polymerize while deposited on the textile material so as to uniformly and coherently cover the textile material with a conductive film of polymerized compound: the improvement wherein in step (a) a ferric salt is used as the oxidizing agent and a weak complexing agent for ferric ions is included in the aqueous solution, whereby in steps (b) and (c) the reaction rate is effectively controlled such that the pre-polymer is uniformly and coherently adsorbed onto the surface of the textile material while effectively avoiding undesired formation of polymer in solution.

As mentioned briefly above it is the prepolymer that is deposited onto the surface of the textile material. This deposition phenomenon may be said to be related to, or a species of, the more conventionally understood adsorption phenomenon. While the adsorption phenomenon is not necessarily a well known phenomenon in terms of textile finishing operations, it certainly has been known that monomeric materials may be adsorbed to many substrates including textile fabrics. The adsorption of polymeric materials from the liquid phase onto a solid surface is a phenomenon which is known, to some extent, especially in the field of biological chemistry. For example, reference is made to U.S. Pat. No. 3,909,195 to Machell, et. al. and U.S. Pat. No. 3,950,589 to Togo, et. al. which show methods for treating textile fibers with polymerizable compositions, although not in the context of electrically conductive fibers.

As described in Ser. No. 81,069, deposition of the forming prepolymer of either pyrrole or aniline is caused to occur by controlling the type and concentration of polymerizable compound and/or oxidant in the aqueous reaction medium and by controlling other reaction conditions, such as reaction temperature, additives, etc. If the reaction conditions, such as concentration of polymerizable compound (relative to the textile material and/or aqueous phase) and/or oxidant, reaction temperature, etc. are conducive to high polymerization rates, polymerization may occur virtually instantaneously both in solution and on the surface of the textile material and a black powder, e.g. "pyrrole black", will be formed which will settle to the bottom of the reaction flask. If, however, the concentration of polymerizable compound, in the aqueous phase and relative to the textile material, is maintained at relatively low levels, or the reaction temperature is lowered, polymerization occurs at a sufficiently slow rate, and the prepolymer species will be deposited entirely onto the textile material before polymerization is completed. Reaction rates may become so slow that the total time takes several minutes, for example five minutes or longer, until a significant change in the appearance of the reaction solution is observed and the polymerization reaction commences. Too long time periods may become commercially disadvantageous or even unacceptable. If a textile material is present under acceptable reaction conditions in this solution of forming pre-polymer, the forming species, while still in solution, or in colloidal suspension will be deposited onto the surface of the textile material and a uniformly coated textile material having a thin, coherent, and ordered conductive polymer film on its surface will be obtained.

Controlling the rate of prepolymer deposition onto the surface of the fibers of the textile material is not only of importance for controlling the reaction conditions to optimize yield and proper formation of the polymer on the surface of the individual fibers, but it in addition influences the molecular weight and order of the deposited polymer. Higher molecular weight and higher order in electrically conductive polymers, in general, imparts higher conductivity and, most significantly, higher stability to these products.

Therefore, in this invention the deposition of the prepolymer onto the surface of the fibers is more effectively achieved over a broader range of concentrations of monomer, oxidant or textile material and over a broader range of other reaction conditions, including, importantly, reaction temperature, by providing for the controlled release of the ferric ion ($Fe^{+3}$) oxidant into the aqueous solution. This controlled release is accomplished by forming a weak complex of the $Fe^{+3}$ ion with a suitable complexing agent.

Suitable complexing agents for use in this invention may be characterized as forming a weak complex with the ferric ions. If the complex formed is too stable, such as the complex formed with EDTA, no reaction takes place.

Exemplary of compounds capable of forming such weak complexes with $Fe^{+3}$ include aromatic, hydroxycarboxylic acids, e.g., salicylic acid, sulfosalicylic acid, and hydroxynaphthoic mono- and dicarboxylic acids or their sulfonic acid derivatives. Other complexing agents which may be employed include certain, acidic aromatic phenols capable of complexing with ferric ions such as phenol sulfonic acid, especially paraphenol sulfonic acid, which compounds may also function as doping agents through the presence of the aromatic sulfonic acid group. The preferred compound is sulfosalicylic acid, more particularly 5-sulfosalicylic acid which optionally may also function not only as a complexing agent for the ferric ions but if present in sufficient amounts also as a doping agent or counter ion for the polymeric material.

The complex between the ferric ion ($Fe^{+3}$) derived, for instance, from the oxidant compound $F3Cl_3$ and the complexing agent can be formed by adding the complexing agent to an aqueous solution containing the oxidant or by adding the oxidant to an aqueous solution containing the complexing agent or by simultaneously adding the complexing agent and oxidant to an aqueous solution. The aqueous solution may already contain the polymerizable monomer or the polymerizable monomer may be added to the aqueous solution after formation of the complex. Alternatively, each of the reactants monomer, complexing agent and oxidant may be simultaneously added to the aqueous reaction medium. Furthermore, any of the reactants may be added directly to the aqueous reaction medium preferably after first being dissolved or suspended in water.

The amount of complexing agent used may be varied to obtain the desired rate. Suitable amounts may range for 0.1 mole complexing agent per mole of ferric ion to amounts in excess of 3.0 moles complexing agent per mole of ferric ion. Amounts in excess of 3.0 moles complexing agent per mole of ferric ion are used when the complexing agent is also used as a doping agent for the conductive polymer.

Pyrrole is the preferred pyrrole monomer, both in terms of the conductivity of the doped polypyrrole films and for its reactivity. However, other pyrrole monomers, including N-methylpyrrole, 3-methylpyrrole, 3,5-dimethylpyrrole, 2,2' bipyrrole, and the like, especially N-methylpyrrole can also be used. More generally, the pyrrole compound may be selected from pyrrole, 3-, and 3,4-alkyl and aryl substituted pyrrole, and N-alkyl, and N-aryl pyrrole. In addition, two or more pyrrole monomers can be used to form conductive copolymers, especially those containing predominantly pyrrole, especially at least 50 mole percent, preferably at least 70 mole percent, and especially preferably at least 90 mole percent of pyrrole. In fact, the addition of the pyrrole derivative as comonomer having a lower polymerization reaction rate than pyrrole may be used to effectively lower the overall polymerization rate. Use of other pyrrole monomers is, however, not preferred, particularly when especially low resistivity is desired, for example, below about 1,000 ohms per square.

While certain of the complexing agents described above may function as doping agents as well, thus performing a dual role, it is to be understood that a separate doping agent may optionally be used. For this purpose any of a wide variety of anionic counter ions may be employed such as iodine chloride and perchlorate, provided by, for example, $I_2$, HCl, $HClO_4$, and their salts and so on, can be used. Other suitable anionic counter ions include, for example, sulfate, bisulfate, sulfonate, sulfonic acid, fluoroborate, $PF_5$—, $AsF_6$—, and $SbF_6$— and can be derived from the free acids, or soluble salts of such acids, including inorganic and organic acids and salts thereof. Furthermore, as is well known, certain oxidants, such as ferric chloride, ferric perchlorate, cupric fluoroborate, and others, can provide the oxidant function and also supply the anionic counter ion. However, if the oxidizing agent is itself an anionic counter ion it may be desirable to use one or more other doping agents in conjunction with the oxidizing agent.

The deposition rates and polymerization rates may be further controlled by other variables in the process such as pH, which is preferably maintained at from about five to about one; and temperature, preferably maintained at from about 0° C. to 30° C. Still further factors include, for instance, the presence of surface active agents or other monomeric or polymeric materials in the reaction medium which may interfere with and/or slow down the polymerization rate. With regard to deposition rate, the addition of electrolytes, such as sodium chloride, calcium chloride, etc. may enhance the rate of deposition.

The deposition rate also depends on the driving force of the difference between the concentration of the adsorbed species on the surface of the textile material and the concentration of the species in the liquid phase exposed to the textile material. This difference in concentration and the deposition rate also depend on such factors as the available surface area of the textile material exposed to the liquid phase and the rate of replenishment of the prepolymer in the vicinity of the surfaces of the textile material available for deposition.

Therefore, it follows that best results in forming uniform, coherent, conductive polymer films on the textile material are achieved by continuously agitating the reaction system in which the textile material is in contact during the entire polymerization reaction. Such agitation can be provided by simply shaking or vibrating or tumbling the reaction vessel in which the textile material is immersed in the liquid reactant system or alternatively, the liquid reactant system can be caused to flow through and/or across the textile material.

As an example of this later mode of operation, it is feasible to force the liquid reaction system over and through a spool or bobbin of wound textile filaments, fibers (e.g. spun fibers), yarn or fabrics, the degree of force applied to the liquid being dependent on the winding density, a more tightly wound and thicker product requiring a greater force to penetrate through the textile and uniformly contact the entire surface of all of the fibers or filaments or yarn. Conversely, for a loosely wound or thinner yarn or filament package, correspondingly less force need be applied to the liquid to cause uniform contact and deposition. In either case, the liquid can be recirculated to the textile material as is customary in many types of textile treating processes. Yarn packages up to 10 inches in diameter have been treated by the process of this invention to provide uniform, coherent, smooth polymer films. The observation that no particulate matter is present in the coated conductive yarn package provides further evidence that it is not the polymer particles, per se—which are water-insoluble and which, if present, would be filtered out of the liquid by the yarn package—that are being deposited onto the textile material.

As an indication that the polymerization parameters, such as reactant concentrations, temperature, and so on, are being properly maintained, such that the rate of deposition of the prepolymer is sufficiently high that the polymer does not accumulate in the aqueous liquid phase, the liquid phase should remain clear or at least substantially free of particles visible to the naked eye throughout the polymerization reaction.

One particular advantage of the process of this invention is the effective utilization of the polymerizable monomer. Yields of pyrrole polymer, for instance, based on pyrrole monomer, of greater than 50%, especially greater than 75%, can be achieved.

When the process of this invention is applied to textile fibers, filaments or yarns directly, whether by the above-described method for treating a wound product, or by simply passing the textile material through a bath of the liquid reactant system until a coherent uniform conductive polymer film is formed, or by any other suitable technique, the resulting composite electrically conductive fibers, filaments, yarns, etc. remain highly flexible and can be subjected to any of the conventional knitting, weaving or similar techniques for forming fabric materials of any desired shape or configuration, without impairing the electrical conductivity.

Furthermore, another advantage of the present invention is that the rate of oxidative polymerization can be effectively controlled to a sufficiently low rate to obtain desirably ordered polymer films of high molecular weight to achieve increased stability, for instance against oxidative degradation in air.

While the precise identity of the adsorbing species has not been identified with any specificity, certain theories or mechanisms have been advanced although the invention is not to be considered to be limited to such theories or proposed mechanisms. It has thus been suggested that in the chemical or electrochemical polymerization, the monomer goes through a cationic, free radical ion stage and it is possible that this species is the species which is adsorbed to the surface of the textile fabric. Alternatively, it may be possible that oligomers or prepolymers of the monomers are the species which are deposited onto the surface of the textile fabric. In general, the amount of textile material per liter of aqueous liquor may be from about 1 to 5 to 1 to 50, preferably from about 1 to 10 to about 1 to 30. A wide variety of textile materials may be employed in the method of the present invention, for example, fibers, filaments, yarns and various fabrics made therefrom. Such fabrics may be woven or knitted fabrics and are preferably based on synthetic fibers, filaments or yarns. In addition, even non-woven structures, such as felts or similar materials, may be employed. Preferably, the polymer should be deposited onto the entire surface of the textile. This result may be achieved, for instance, by the use of a relatively loosely woven or knitted fabric but, by contrast, may be relatively difficult to achieve if, for instance, a highly twisted thick yarn were to be used in the fabrication of the textile fabric. The penetration of the reaction medium through the entire textile material is, furthermore, enhanced if, for instance, the fibers used in the process are texturized textile fibers.

Fabrics prepared from spun fiber yarns as well as continuous filament yarns may be employed. In order to obtain optimum conductivity of a textile fabric, however, it may be desirable to use continuous filament yarns so that a film structure suitable for the conducting of electricity . runs virtually continuously over the entire surface of the fabric. In this regard, it has been observed, as would be expected, that fabrics produced from spun fibers processed according to the present invention typically show somewhat less conductivity than fabrics produced from continuous filament yarns.

A wide variety of synthetic fibers may be used to make the textile fabrics of the present invention. Thus, for instance, fabric made from synthetic yarn, such as polyester, nylon and acrylic yarns, may be conveniently employed. Blends of synthetic and natural fibers may also be used, for example, blends with cotton, wool and other natural fibers may be employed The preferred fibers are polyester, e.g. polyethylene terephthalate including cationic dyeable polyester and polyamides, e.g. nylon, such as Nylon 6, Nylon 6,6, and so on. Another category of preferred fibers are the high modulus fibers such as aromatic polyester, aromatic polyamide and polybenzimidazole. Still another category of fibers that may be advantageously employed include high modulus inorganic fibers such as glass and ceramic fibers. Although it has not been clearly established, it is believed that the sulfonate groups or amide groups present on these polymers may function as a "built-in" doping agent.

Conductivity measurements have been made on the fabrics which have been prepared according to the method of the present invention. Standard test methods are available in the textile industry and, in particular, AATCC test method 76-1982 is available and has been used for the purpose of measuring the resistivity of textile fabrics. According to this method, two parallel electrodes 2 inches long are contacted with the fabric and placed 1 inch apart. Resistivity may then be measured with a standard ohm meter capable of measuring values between 1 and 20 million ohms. Measurements must then be multiplied by 2 in order to obtain resistivity in ohms on a per square basis. While conditioning of the samples may ordinarily be required to specific relative humidity levels, it has been found that conditioning of the samples made according to the present invention is not necessary since conductivity measurements do not vary significantly at different humidity levels. The measurements reported in the following example, are however, conducted in a room which is set to a temperature of 70° F. and 50% relative humidity. Resistivity measurements are reported herein and in the examples in ohms per square (Ω/sq) and under these conditions the corresponding conductivity is one divided by resistivity. In general, fabrics treated according to the method of the present invention show resistivities of below $10^6$ ohms per square, such as in the range of from about 50 to 500,000 ohms per square, preferably from about 500 to 5,000 ohms per square. These sheet resistivities can be converted to volume resistivities by taking into consideration the weight and thickness of the polymer films. Some samples tested after aging for several months do not significantly change with regard to resistivity during that period of time. In addition, samples heated in an oven to 380° F. for about one minute also show no significant loss of conductivity under these conditions. These results indicate that the stability of the conductive film made according to the process of the present invention on the surface of textile materials is excellent, indicating a higher molecular weight and a higher degree of order than usually obtained by the chemical oxidation of these monomers.

The invention may be further understood by reference to the following examples but the inventor is not to be construed as being unduly limited thereby. Unless otherwise indicated, all parts and percentages are by weight.

EXAMPLE 1

An eight ounce jar is charged with 5 grams of a polyester fabric consisting of a 2×2 right hand twill weighing approximately 6.6 ounce per square yard and being constructed from a 2/150/34 textured polyester yarn from Celanese Type 667 (fabric construction is such that approximately 70 ends are in the warp direction and 55 picks are in the fill direction). 50 cc of water is added to the jar and the jar is closed and the fabric is properly wetted out with the initial water charge. 1.7 grams of ferric chloride hexahydrate is then dissolved in 50 cc of water and this amount is added to the jar and mixed with the previous charge of water. Then 0.2 gram of freshly distilled pyrrole is added separately to 50 cc of water and 1 gram of 5 sulfosalicylic acid is added and dissolved. This mixture is then added at once to the jar; the jar is closed and shaken by hand to mix its contents. Immediately, the entire mixture develops a deep purple color indicating the instant formation of the complex between iron and $Fe^{+3}$ and sulfosalicylic acid. The jar is then put in a rotating clamp and rotated at approximately 60 RPM for six hours. The fabric is then withdrawn and rinsed three times with water and then air dried. The resulting fabric shows a resistivity of 125 ohms in the warp direction and 190 ohms in the fill direction respectively.

EXAMPLE 2

Following the procedure described in Example 1 an identical piece of polyester fabric was treated except that 4.5 grams of ferric chloride hexahydrate, 0.5 gram of pyrrole and 5 grams of sulfosalicylic acid were used. Again, the total liquor consisted of 150 cc and the jar was rotated for six hours. The resulting fabric has a dark black color and showed a resistivity of 23 and 30 ohms per square in the warp and fill direction respectively.

EXAMPLES 3-5

Example 1 is repeated using the same fabric and the original amount of ferric chloride hexahydride and pyrrole. The amount of sulfosalicylic was varied from 1.4 grams, 2.7 grams and 4.1 grams representing approximately 1 molar and 2 and 3 molar amounts of sulfosalicylic acid per mole of ferric chloride hexahydrate. The following resistivities in ohms per square were obtained on these fabrics:

| Example 3 | Example 4 | Example 5 |
|---|---|---|
| 105 × 140 | 80 × 100 | 60 × 80 |

EXAMPLE 6

Example 1 is repeated with the same fabric and instead of sulfosalicylic acid, 1 gram of 1 napthol 3-6 disulfonic acid disodium salt was used. The complex formed in this mixture was of a dark blue color and the reaction was considerably faster than in Example 1. The duration of the polymerization was two hours and the fabric showed a resistivity of 450,000 and 500,000 per square in the warp and fill direction respectively.

EXAMPLE 7-9

Example 1 is repeated except that 6.5 grams of a textured Nylon 6,6 fabric is used. The procedure of Examples 3-5 was followed the only variation being the amount of sulfosalicylic acid used, namely 0.7, 1.4 and 4.2 grams representing one-half molar, 1 molar and 3 molar amounts of sulfosalicylic acid in respect to the ferric chloride hexahydrate used. The polymerization of pyrrole in these experiments using nylon is considerably faster than the corresponding experiments using polyester and, therefore, the reaction was stopped after 90 minutes. The following resistivities were obtained:

| Example 7 | Example 8 | Example 9 |
|---|---|---|
| 300 × 440 | 300 × 370 | 180 × 220 |

EXAMPLE 10

Example 8 was repeated except that no pyrrole was added to this mixture. Upon combination of all ingredients the nylon fabric assumes a dark purple color indicating adsorption of the complex to the surface of the fabric. A determination of the amount of iron in the liquor at the beginning and after 90 minutes is reported below.

| 0 Minutes | 90 Minutes |
|---|---|
| 1930 PPM | 1870 PPM |

As one can see, considerable amounts of the iron got absorbed, probably in form of its complex with 5-sulfosalicylic acid, to the surface of the fabric. This explains the increased reaction rates observed in Example 7-9.

EXAMPLE 11

The same experiment as reported in Example 7-9 was repeated except that no sulfosalicylic acid was added. The resulting black fabric showed a resistivity of 810 ohms and 985 ohms in the warp and fill direction respectively.

EXAMPLE 12

Example 8 was repeated but instead of an equi molar amount of sulfosalicylic acid, an equi-molar amount of salicylic acid was used. (0.9 grams). After 90 minutes the fabric was washed and dried and showed a resistivity of 800 ohms in the warp direction and 945 ohms in the fill direction. As can be seen from the data in Example 11 and 12, the salicylic acid is ineffective in doping the polypyrrole to a high degree of conductivity.

EXAMPLE 12

The experiment of Example 12 is repeated but instead of an equi molar amount of salicylic acid, an equi-molar amount of para-phenol sulfonic acid (1.5 grams) is used. The resulting fabric has a resistivity of 245 ohms in the fill direction and 290 ohms in the warp direction respectively. This result is not as desirable as described in Experiment 8 but more desirable than described in Experiment 12.

What is claimed is:

1. A method for imparting electrical conductivity to a textile material, which comprises: (a) contacting the textile material with an aqueous solution of an oxidatively polymerizable pyrrole compound and an oxidizing agent capable of oxidizing said compound to a polymer, said contacting being carried out in the presence of a counter ion or doping agent which imparts electrical conductivity to said polymer when fully formed, said contacting being under conditions at which the pyrrole compound and the oxidizing agent react with each other to form a prepolymer in said aqueous solution; (b) depositing onto the surface of the textile material the prepolymer of the polymerizable compound; and (c) allowing the prepolymer to polymerize while deposited on the textile material so as to uniformly and coherently cover the textile material with a conductive film of polymerized compound; the improvement wherein in step (a) a ferric salt is used as the oxidizing agent and a weak complexing agent for ferric ions is included in the aqueous solution, in an amount sufficient to effectively control the polymerization rate of steps (b) and (c) such that the prepolymer is uniformly and coherently adsorbed onto the surface of the textile material while effectively avoiding undesired formation of polymer in solution.

2. The method of claim 1 wherein said pyrrole compound is selected from the group consisting of pyrrole, a 3- and 3,4-alkyl or aryl substituted pyrrole, N-alkyl pyrrole and N-aryl pyrrole.

3. The method of claim 1 wherein said weak complexing agent is selected from aromatic, hydroxycarboxylic acids, and aromatic, hydroxysulfonic acids.

4. The method of claim 3 wherein said weak complexing agent is sulfosalicylic acid.

5. The method of claim 1 wherein said pyrrole compound is present in said solution in an amount of from about 0.01 to 5 grams per liter.

6. The method of claim 1 wherein said textile material comprises a knitted, woven or non-woven fibrous textile fabric.

7. The method of claim 6 where the fibers of said fabric are uniformly and coherently covered with said conductive film to a thickness of from about 0.05 to about 2 microns.

8. The method of claim 6 wherein said textile fabric is constructed of continuous filament yarns.

9. The method of claim 8 wherein said textile fabric comprises synthetic fibers selected from the group consisting of polyester, nylon and acrylic fibers.

10. The method of claim 8 wherein said textile fabric comprises high modulus fibers selected from aromatic polyester, aromatic polyamide and polybenzimidazole fibers.

11. The method of claim 8 wherein said textile material comprises high modulus inorganic fibers selected from glass and ceramic fibers.

12. The method of claim 7 wherein said treated textile fabric has a resistivity from about 50 to about 500,000 ohms per square.

13. The method of claim 7 wherein said textile material is or is comprised of basic dyeable polyester fibers.

14. The method of claim 1 wherein said textile material comprises a wound yarn, filament or fiber.

15. The method of claim 1 wherein said pyrrole compound is pyrrole, N-methylpyrrole or a mixture of pyrrole and N-methylpyrrole.

16. The method of claim 1 wherein said counter ion is an anionic counter ion selected from the group consisting of chloride, sulfate, alkyl or aryl-sulfonic acid, and aryl disulfonic acids.

17. An electrically conductive textile material which is the product of the process of claim 1, having a resistivity in the range of from about 50 to about $10^6$ ohms per square.

18. The electrically conductive material of claim 17 which is a fabric comprised of fibers, filaments or yarns of polyester or polyamide.

19. The electrically conductive material of claim 17 wherein the pyrrole compound is pyrrole and the polypyrrole film has a thickness of less than about 2 microns.

* * * * *